US009675183B2

(12) United States Patent
Saint et al.

(10) Patent No.: US 9,675,183 B2
(45) Date of Patent: Jun. 13, 2017

(54) ACCESSORIES SUITABLE FOR USE WITH AN INFANT PLAYPEN AND MOUNT ASSEMBLY FOR INSTALLING THE SAME

(71) Applicants: Nathanael Saint, Morgantown, PA (US); Jonathan K. Mountz, Geigertown, PA (US); Andrew J. Winterhalter, West Lawn, PA (US); Jonathan M. Pacella, Coatesville, PA (US); William B. Bellows, Wyomissing, PA (US)

(72) Inventors: Nathanael Saint, Morgantown, PA (US); Jonathan K. Mountz, Geigertown, PA (US); Andrew J. Winterhalter, West Lawn, PA (US); Jonathan M. Pacella, Coatesville, PA (US); William B. Bellows, Wyomissing, PA (US)

(73) Assignee: Wonderland Nursery Goods Company Limited, Hong Kong (HK)

( * ) Notice: Subject to any disclaimer, the term of this patent is extended or adjusted under 35 U.S.C. 154(b) by 148 days.

(21) Appl. No.: 14/148,961

(22) Filed: Jan. 7, 2014

(65) Prior Publication Data

US 2014/0191173 A1 Jul. 10, 2014

Related U.S. Application Data

(60) Provisional application No. 61/848,642, filed on Jan. 8, 2013, provisional application No. 61/855,383, filed on May 14, 2013.

(51) Int. Cl.
*A47D 13/06* (2006.01)

(52) U.S. Cl.
CPC ..... *A47D 13/063* (2013.01); *A47D 13/06* (2013.01); *A47D 13/061* (2013.01)

(58) Field of Classification Search
CPC .... A47D 13/06; A47D 13/061; A47D 13/063; A47D 13/065; A47D 13/066; A47D 13/068; A47D 15/008
See application file for complete search history.

(56) References Cited

U.S. PATENT DOCUMENTS 3,004,793 A * 10/1961 Loomis ..... A47D 1/00 297/274
5,339,470 A * 8/1994 Shamie ..... A47D 13/063 5/93.2

(Continued)

FOREIGN PATENT DOCUMENTS

CN 1274559 A 11/2000
CN 101797110 A 8/2010

(Continued)

OTHER PUBLICATIONS

Office Action of Chinese Patent Application No. 201410006919.1 dated Nov. 2, 2015.

*Primary Examiner* — David E Sosnowski
*Assistant Examiner* — Amanda L Miller
(74) *Attorney, Agent, or Firm* — Baker & McKenzie LLP; David I. Roche

(57) ABSTRACT

A mount assembly includes a playpen frame, a support frame that can provide support for a bassinet in the playpen frame, and multiple bar segments to provide support for a utility accessory positioned side-by-side relative to the bassinet. The playpen frame includes two first upper side rail assemblies each having a fixed wall, and a second upper side rail assembly connected with the two first upper side rail assemblies. The support frame includes two connectors operable to respectively attach to and detach from the fixed walls. Each connector is formed to include a socket. The two connectors can attach to the fixed walls respectively near a middle of the two first upper side rail assemblies. The bar (Continued)

segments are mountable to the playpen frame, one of the bar segments once mounted to the playpen frame having an end portion resting in contact with the socket of one connector.

25 Claims, 20 Drawing Sheets

(56) References Cited

U.S. PATENT DOCUMENTS 5,349,709 A * 9/1994 Cheng ..... A47D 7/03 5/93.1
5,991,944 A * 11/1999 Yang ..... A47D 7/04 403/231
6,332,231 B1 * 12/2001 Wang ..... A47D 5/00 5/503.1
8,387,807 B2 * 3/2013 Chen ..... A47D 7/007 211/119.006
8,677,533 B2 * 3/2014 Barron ..... A47D 9/005 5/655
9,351,586 B2 * 5/2016 Burkholder ..... A47D 7/00
2001/0001161 A1 * 5/2001 Warner, Jr. ..... A47D 5/006 5/99.1
2006/0225205 A1 * 10/2006 Troutman ..... A47D 5/00 5/93.1
2006/0253979 A1 11/2006 Chen
2008/0271243 A1 * 11/2008 Burkholder ..... A47D 7/04 5/93.2
2013/0125304 A1 5/2013 DeHart et al.

FOREIGN PATENT DOCUMENTS

CN 102396926 A 4/2012
GB 2387539 A 10/2003

* cited by examiner

ACCESSORIES SUITABLE FOR USE WITH AN INFANT PLAYPEN AND MOUNT ASSEMBLY FOR INSTALLING THE SAME

CROSS-REFERENCE TO RELATED APPLICATIONS

This application claims priority to U.S. Provisional Patent Application No. 61/848,642 filed on Jan. 8, 2013, and to U.S. Provisional Patent Application No. 61/855,383 filed on May 14, 2013, both of which are incorporated herein by reference.

BACKGROUND

1. Field of the Invention

The present invention relates to mount assemblies for installing multiple accessories in an infant playpen.

2. Description of the Related Art

An infant playpen may be typically used in combination with diverse accessories that can facilitate care for the child, such as bassinets and changing stations. Because the infant playpen is almost entirely covered with a fabric material, the connections of the accessories with the frame of the infant playpen may be difficult to achieve. For example, the playpen frame may need to include specific attachment features used for fastening a bassinet and a changing station on the playpen frame. The conventional attachment features may result in a more complex construction for assembling the accessories with the playpen frame.

Therefore, there is a need for an improved design that can provide a mount assembly for installing multiple accessories with an infant playpen that is more convenient in use, and can address at least the foregoing issues.

SUMMARY

The present application describes a set of accessories suitable for use in combination with an infant playpen, and a mount assembly for installing the accessories in an interior of the infant playpen. In one embodiment, the mount assembly includes a playpen frame, a support frame configured to provide support for a bassinet in an interior of the playpen frame, and a plurality of bar segments to provide support for a utility accessory positioned side-by-side relative to the bassinet. The playpen frame includes two first upper side rail assemblies opposite to each other, and a second upper side rail assembly connected with the two first upper side rail assemblies, each of the two first upper side rail assemblies respectively having a fixed wall. The support frame includes two connectors operable to respectively attach to and detach from the fixed walls, each of the two connectors being respectively formed to include a socket, and the two connectors being operable to attach to the fixed walls respectively near a middle of the two first upper side rail assemblies. The bar segments are mountable to the playpen frame, one of the bar segments once mounted to the playpen frame having at least an end portion resting in contact with the socket of one of the two connectors.

The application also describes a set of accessories installable in an infant playpen. The set of accessories includes a bassinet, a utility accessory, a support frame configured to provide support for the bassinet in an interior of a playpen frame, and two bar segments mountable to the playpen frame to provide support for the utility accessory. The support frame includes at least two connectors operable to attach to and detach from two opposite upper side rail assemblies of the playpen frame, each of the connectors being respectively formed to include a socket. The support frame and the bar segments are positionable to respectively receive a side-by-side placement of the bassinet and the utility accessory, the socket of each of the two connectors being configured to receive an end portion of one bar segment.

DETAILED DESCRIPTION OF THE EMBODIMENTS

Figure 1:
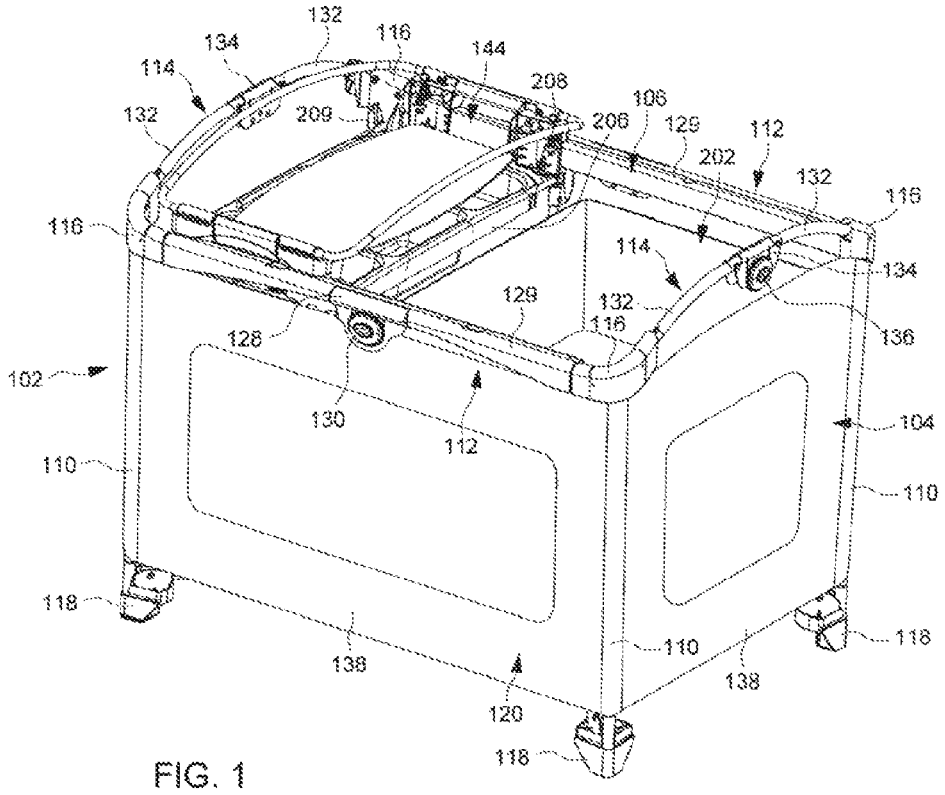
FIG. 1 is a perspective view illustrating one embodiment of an infant playpen.

FIG. 1 is a perspective view illustrating one embodiment of an infant playpen 100 provided with a mount assembly for installing multiple accessories thereon. The infant playpen 100 can include a playpen frame 102 formed by the assembly of multiple tube segments, and an enclosure 104 connected with the playpen frame 102 and surrounding an interior 106 of the infant playpen 100. The playpen frame 102 can include a plurality of corner frame portions 110, two upper side rail assemblies 112 opposite to each other and extending substantially parallel to each other along a first direction, and two other upper side rail assemblies 114 opposite to each other and extending substantially parallel to each other along a second direction perpendicular to the first direction, the upper side rail assemblies 114 being respectively connected with the upper side rail assemblies 112 via a plurality of corner joints 116.

Each of the corner frame portions 110 can be formed by an upright tubular segment that has a lower end affixed with a foot member 118, and an upper end affixed with one corner joint 116. The foot members 118 can also be pivotally connected with distal ends of a linkage assembly 120 (better shown in FIG. 2) having a cross shape. The linkage assembly 120 can include a central pivot joint 122, and four tubes 124 arranged along two diagonal directions connecting at the central pivot joint 122. The linkage assembly 120 can provide support at the bottom of the infant playpen 100.

Each of the two upper side rail assemblies 112 can respectively include two tubular segments 126 (better shown in FIG. 6) pivotally connected with each other via a hinge 128 at a central location thereof, and one or more rail segment 129 assembled over the tubular segments 126. The hinge 128 can include an internal latch operable to lock the two tubular segments 126 in an unfolded state substantially aligned with each other. The hinge 128 can also include a release button 130 operable to unlock the internal latch for allowing folding of the two tubular segments 126. The ends of the two tubular segments 126 distant from the hinge 128 can be respectively affixed with two corner joints 116.

Likewise, each of the two upper side rail assemblies 114 can be respectively formed by two tubular segments 132 pivotally connected with each other via a hinge 134 at a central location thereof. The hinge 134 can include an internal latch operable to lock the two tubular segments 132 in an unfolded state substantially aligned with each other. The hinge 134 can also include a release button 136 operable to unlock the internal latch for allowing folding of the two tubular segments 132. The ends of the two tubular segments 132 distant from the hinge 134 can be respectively affixed with two corner joints 116. The corner joints 116 can thereby respectively connect the two upper side rail assemblies 112 with the two upper side rail assemblies 114 forming the four sides of the playpen frame 102.

The enclosure 104 can include a plurality of sidewall panels 138 respectively connected with each other along edge portions corresponding to the corner frame portions 110. The sidewall panels 138 can be made of soft goods, such as a fabric material. The sidewall panels 138 can be stretched between the corner frame portions 110 to surround the interior space 106 of the infant playpen 100, and can have upper ends respectively secured with the upper side rail assemblies 112 and 114.

A changing platform 144 can be detachably assembled for sliding displacement along the rail segments 129 of the two upper side rail assemblies 112. In particular, the changing platform 144 can travel along the rail segments 129 past the hinges 128 for positional adjustment according to a caregiver's need.

Figure 2:
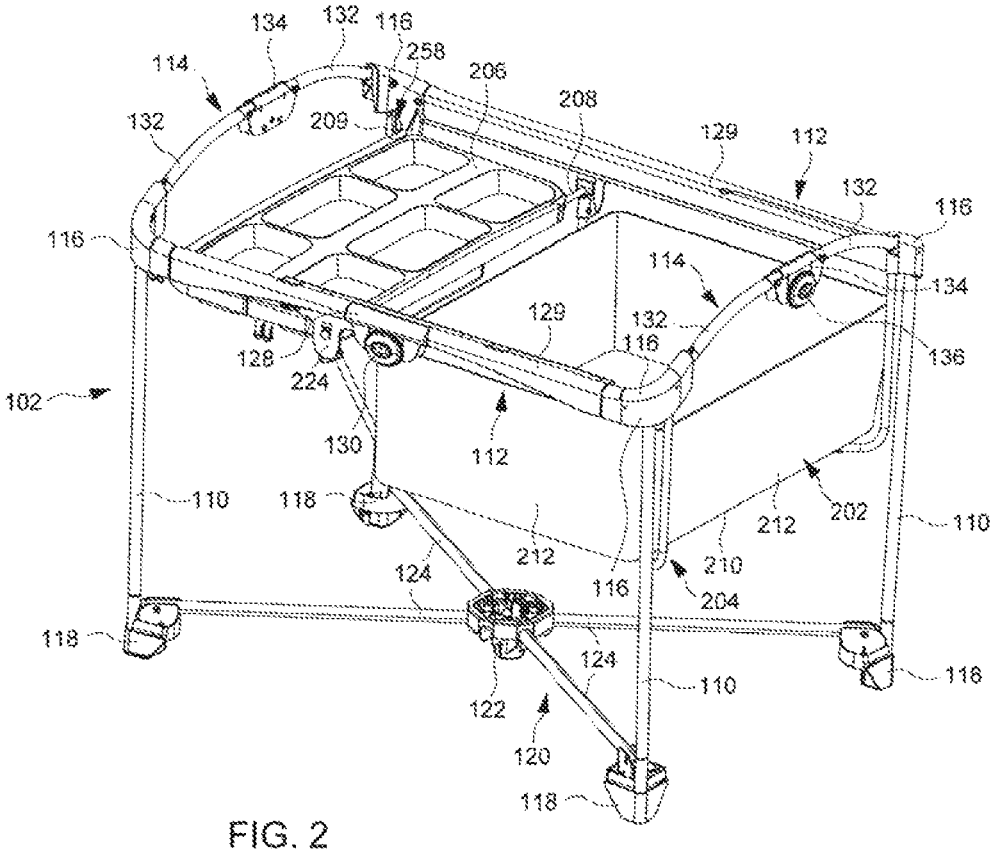
FIG. 2 is a schematic view illustrating a set of multiple accessories arranged with a playpen frame.
Figure 3:
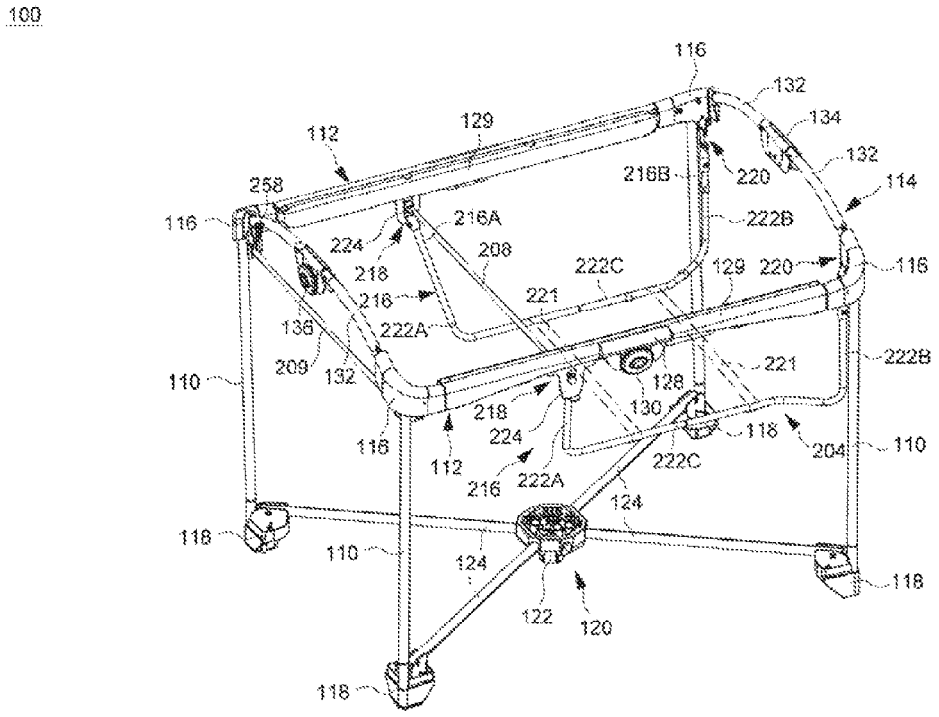
FIG. 3 is a schematic view illustrating a mount assembling for installing the accessories with the playpen frame.

In conjunction with FIG. 1, FIGS. 2 and 3 are schematic views illustrating a set of multiple accessories assembled with the playpen frame 102. The set of accessories can include a bassinet 202, a support frame 204 operable to detachably fasten to the playpen frame 102 for supporting the bassinet 202, a utility accessory 206, and a set of bars 208 and 209 operable to assemble with the playpen frame 102 for supporting the utility accessory 206 side-by-side relative to the bassinet 202. In one embodiment, the utility accessory 206 can be an organizer tray. In other embodiments, the utility accessory 206 may be a support table, storage compartment, etc. For clarity, the representation of the changing platform 144 is omitted in FIGS. 2 and 3, and the bassinet 202 and the utility accessory 206 are not represented in FIG. 3 to better show the support frame 204 and the bars 208 and 209.

The bassinet 202 can be formed with an enclosed structure including a bottom 210, and a plurality of upright sidewalls 212 connected with the bottom 210 that surround an interior space of the bassinet 202 where a baby can be received.

The support frame 204 can include two tubular structures 216, a plurality of connectors 218 and 220 operable to attach the tubular structures 216 to the playpen frame 102, and one or more linkage 221 (shown with phantom lines) connecting the two tubular structures 216 with each other. Each of the tubular structures 216 can have a similar shape formed by one or more segments assembled together. For example, each tubular structure 216 can include two upright segments 222A and 222B, and a middle segment 222C extending between and connected with the upright segments 222A and 222B. The tubular structure 216 thus can have a profile similar to a U-shape.

The two tubular structures 216 can be respectively assembled along the two upper side rail assemblies 112 of the playpen frame 102. Each of the tubular structure 216 can have two upper ends 216A and 216B (i.e., corresponding to the upper ends of the upright segments 222A and 222B) respectively assembled with two connectors 218 and 220. The connector 218 can detachably fasten the upper end 216A of the tubular structure 216 to a fixed wall 224 of the upper side rail assembly 112 near a middle of the upper side rail assembly 112, whereas the connector 220 can detachably fasten the upper end 216B of the tubular structure 216 to the corner joint 116 near a corner of the playpen frame 102.

Figure 4:
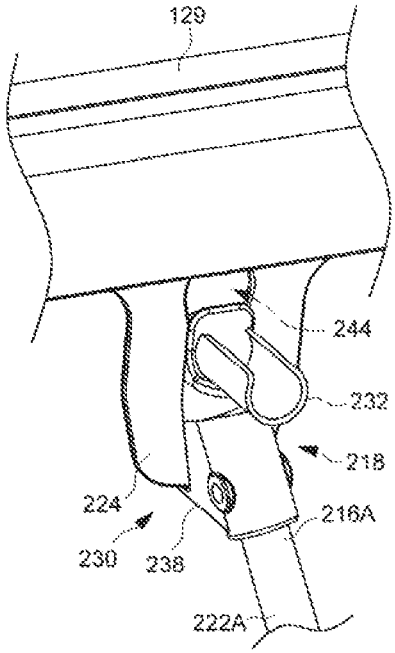
FIGS. 4 and 5 are enlarged views illustrating under different perspectives the construction of a connector used in the mount assembling for installing the accessories with the playpen frame.
Figure 5:
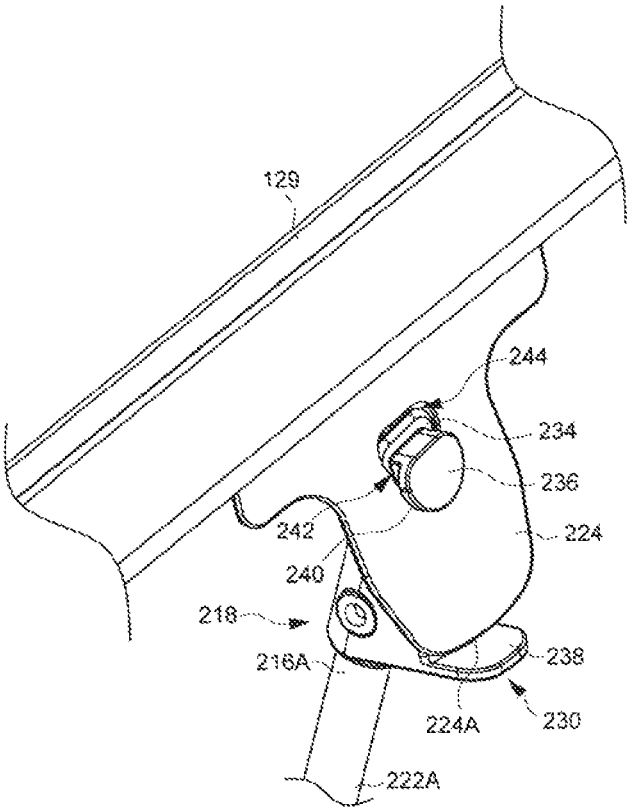

FIG. 4 and FIG. 5 are enlarged views illustrating the construction of the connector 218 that can attach to the wall 224. The connector 218 can be affixed with the upper end 216A of the tubular structure 216. The connector 218 can include a clamping structure 230 and a socket 232. In one embodiment, the connector 218, including the clamping structure 230 and the socket 232, can be formed in a single body by plastic molding. The clamping structure 230 can have a sidewall 234, and two clamping portions 236 and 238 vertically spaced-apart from each other that protrude from the sidewall 234 at one same side of the connector 218. The clamping portion 236 can be formed as a protrusion including a flange 240, and a recess 242 delimited between the flange 240 and the sidewall 234. The clamping portion 238 can have a protruding shape vertically facing the recess 242. The socket 232 can have a curved shape that is opened upward and protrudes at a side of the connector 218 opposite to that of the clamping structure 230. The socket 232 can receive an end portion of the bar segment 208 used for supporting the utility accessory 206.

Referring to FIGS. 4 and 5, the wall 224 can be formed as an extension projecting downward from the rail segment 129, and can include a slot 244. In one embodiment, the slot 244 can have a tapered shape that is larger toward its upper rim and narrower toward its lower rim. The connector 218 can be locked with the wall 224 by engaging the clamping portion 236 through the slot 244 such that the lower rim of the slot 244 is engaged through the recess 242 between the flange 240 and the sidewall 234, and by causing the clamping portion 238 to press against a lower boundary edge 224A of the wall 224. The clamping structure 230 can thereby clamp a portion of the wall 224 between the slot 244 and the lower boundary edge 224A to fasten the connector 218 to the playpen frame 102. Once the connector 218 is fastened to the wall 224, the socket 232 protrudes from the wall 224 in the interior of the playpen frame 102. For removing the connector 218, the wall 224 can be flexed out of the way of the clamping portion 238, and the connector 218 can be displaced upward and out of the slot 244.

Figure 6:
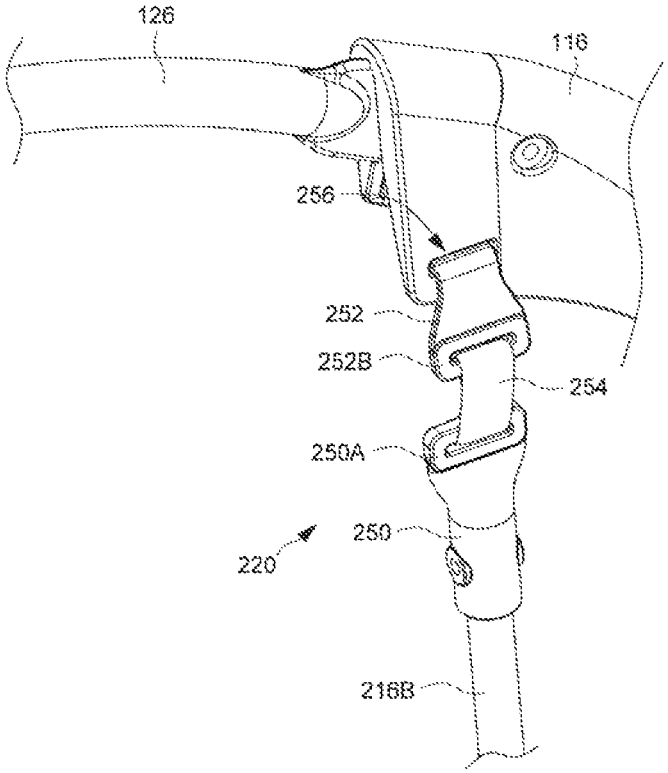
FIGS. 6 and 7 are schematic views illustrating the construction of another connector used in the mount assembling for installing the accessories with the playpen frame.
Figure 7:
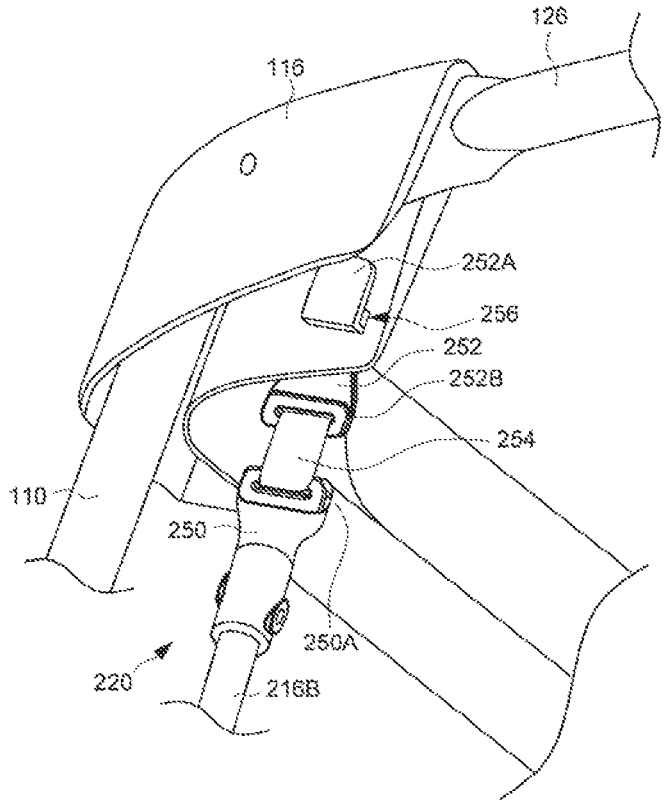

FIGS. 6 and 7 are schematic views illustrating the construction of the connector 220 and how it can assemble with the corner joint 116 of the playpen frame 102. The connector 220 can include a first and a second coupling portion 250 and 252, and a strap 254 having two end portions fixedly secured with the first and second coupling portions 250 and 252. The first coupling portion 250 can be affixed with the upper end 216B of the tubular structure 216, and can include a loop 250A through which the first end portion of the strap 254 can be secured. The second coupling portion 252 can be bent to form a tongue 252A, and include a loop 252B through which the second end portion of the strap 254 can be secured. The tongue 252A can releasibly engage through a slot 256 formed through the corner joint 116 to attach the connector 220 to the corner joint 116.

With the aforementioned construction, the support frame 204 can be affixed with the playpen frame 102 at four attachment points, two first attachment points being implemented by the two connectors 218 on the two upper side rail assemblies 112, and two second attachments points being implemented by the two connectors 220 near two neighboring corners of the playpen frame 102. Once the support frame 204 is assembled with the playpen frame 102, the bassinet 202 can be installed on the middle segments 222C of the two tubular structures 216. Since the connectors 220 include flexible portions formed by the straps 254, some degree of displacement of the support frame 204 relative to the playpen frame 102 may be allowed about the attachment points of the connectors 220.

For installing the utility accessory 206, the bar segment 208 may be arranged perpendicular between the two upper side rail assemblies 112 so that the two opposite ends of the bar segment 208 respectively rest in contact with the respective sockets 232. The other bar segment 209 can be arranged parallel to the bar segment 208, the two opposite ends of the bar segment 209 being respectively received in pockets 258 (better shown in FIGS. 2 and 3) formed in the two other corner joints 116. Once the two bar segments 208 and 209 are properly installed, the utility accessory 206 can be placed and supported on the bars 208 and 209 side-by-side relative to the bassinet 202.

In the aforementioned construction, the two connectors 218 of the support frame 204 for the bassinet 202 can be commonly used for receiving the ends of the bar segment 208 used to support the utility accessory 206. Accordingly, no additional connectors are required for the bar segment 208, and the amount of connectors required for attaching the support structures of the bassinet 202 and the utility accessory 206 to the playpen frame 102 can be reduced.

Figure 8:
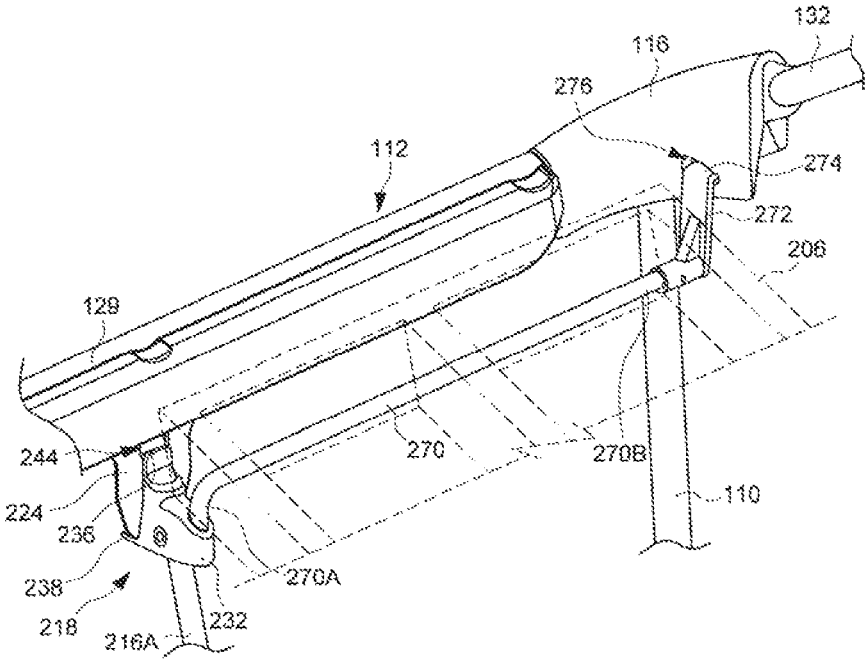
FIG. 8 is a schematic view illustrating a variant embodiment of a support structure for installing a utility accessory.

FIG. 8 is a schematic view illustrating a variant embodiment of a support structure for installing the utility accessory 206 (shown with phantom lines). In this embodiment, two parallel bar segments 270 can be used to support the utility accessory 206. While only one bar segment 270 is shown in FIG. 8, the other bar segment 270 can be assembled in a similar manner on the other side. Each bar segment 270 can have a first end portion 270A formed with a bent shape, and a second end 270B affixed with an end connector 272 having a tongue 274. The bar segment 270 can be arranged so as to extend substantially parallel to and along the side of one corresponding upper side rail assembly 112, the first end portion 270A of the bar segment 270 being resting in contact in the socket 232, and the tongue 274 of the end connector 272 at the other end of the bar segment 270 being engaged through a slot 276 formed through one corner joint 116. The bar segment 270 can thus extend between the connector 218 and the corner joint 116 along one upper side rail assembly 112. The other bar segment 270 can be likewise assembled on the side of the other upper side rail assembly 112. The utility accessory 206 (e.g., an organizer tray) then can be installed and supported by the two bar segments 270 at two opposite sides respectively near the upper side rail assemblies 112.

Figure 9:
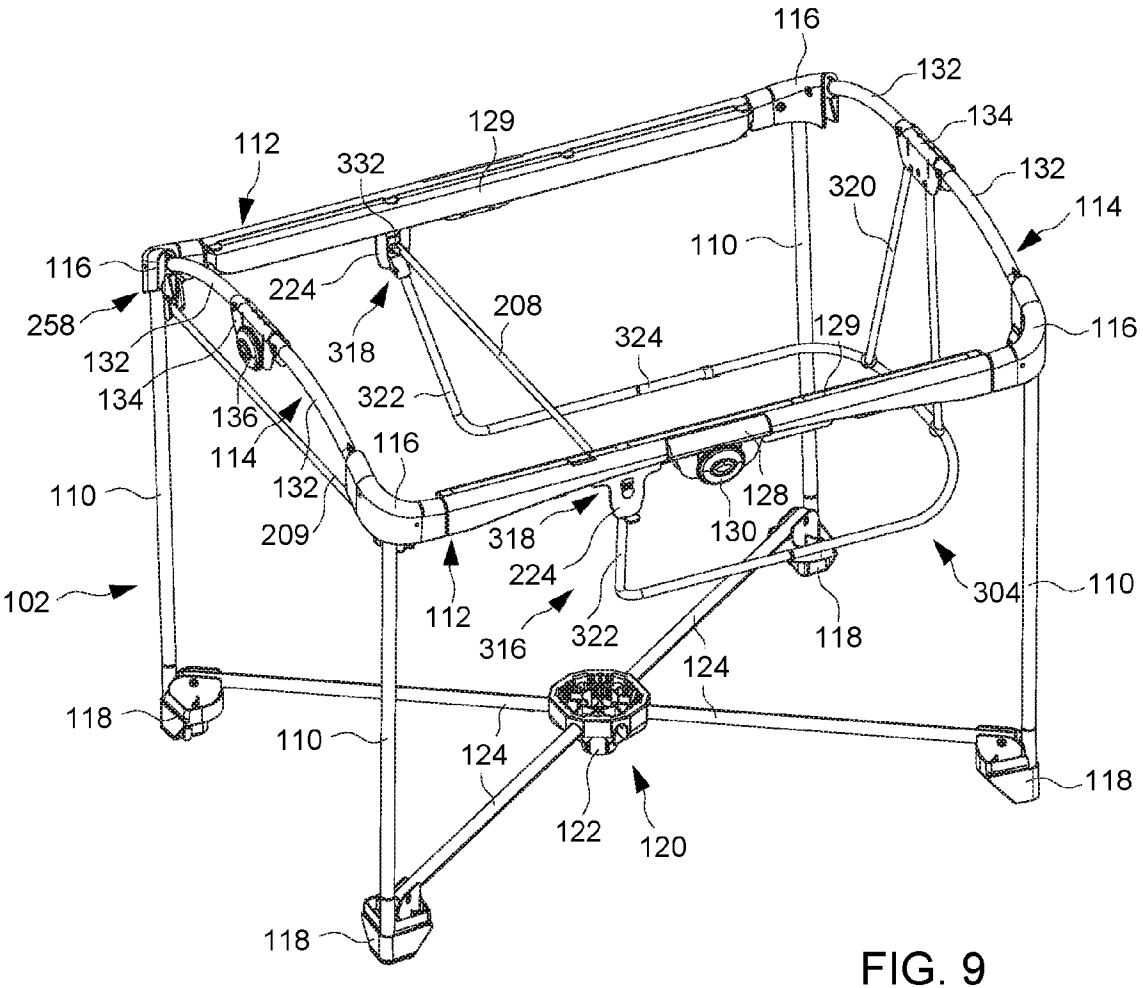
FIG. 9 is a schematic view illustrating a variant embodiment of a support frame used for supporting a bassinet in the playpen frame.

FIG. 9 is schematic view illustrating a variant embodiment of a support frame 304 for the bassinet 202. In FIG. 9, the support frame 304 can include a tubular structure 316, two connectors 318 operable to respectively attach the tubular structure 316 to the two upper side rail assemblies 112 of the playpen frame 102, and a strap assembly 320 operable to attach the tubular structure 316 to the upper side rail assembly 114.

The tubular structure 316 can be formed by the assembly of multiple tubes and include two upright segments 322, and a middle segment 324 extending between and connected with the upright segments 322. The middle segment 324 can have a U-shape, and the two upright segments 322 can be downwardly connected with the middle segment 324 and terminate in upper ends respectively affixed with the two connectors 318.

Each of the connectors 318 may exemplary be similar in structure to the connector 218 previously described, and can be formed to include a socket 332. The strap assembly 320 can include one or more strap that can detachably fasten to a middle of the upper side rail assembly 114 between the two corner joints 116, e.g., at the hinge 134. For example, the strap assembly 320 can be downwardly connected with the middle segment 324 and upwardly connected with the upper side rail assembly 114, so that the support frame 304 is at least partially held in suspension from the playpen frame 102.

Once the support frame 304 is assembled with the two opposite upper side rail assemblies 112 and the upper side rail assembly 114, the bassinet 202 can be placed and rest on the middle segment 324. Moreover, the bar segment 208 can be arranged on the sockets 332 of the two connectors 318 perpendicular to the upper side rail assemblies 112, and the bar segment 209 can be assembled with the two corner joints 116. The utility accessory 206 then can be placed on the middle segment 324 side-by-side with respect to the bassinet 202.

Figure 10:
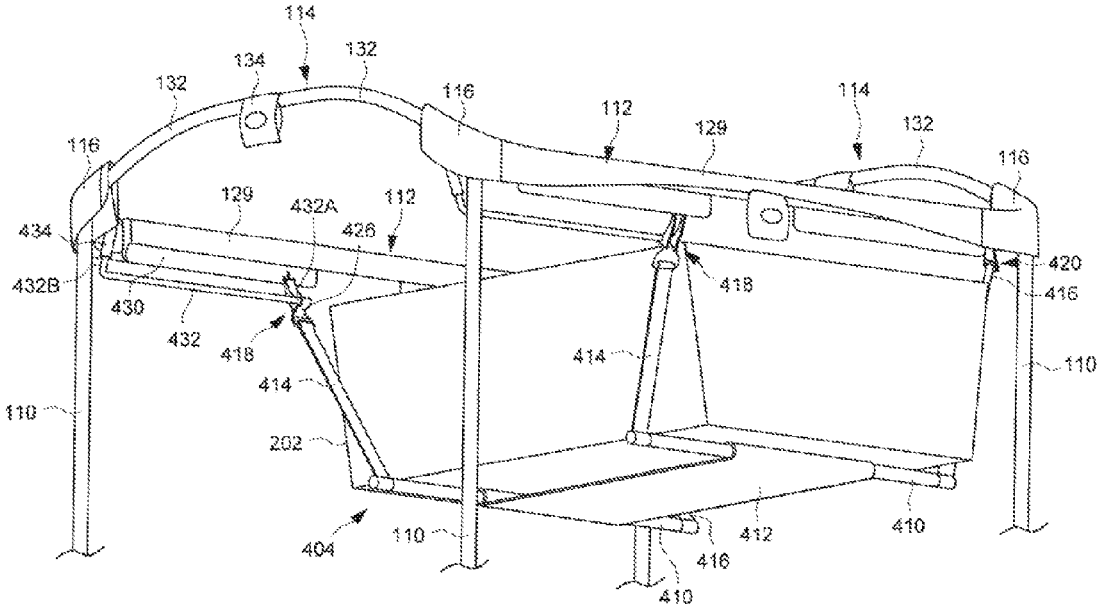
FIGS. 10-12 are schematic views illustrating another variant embodiment of a support frame for supporting the bassinet.
Figure 11:
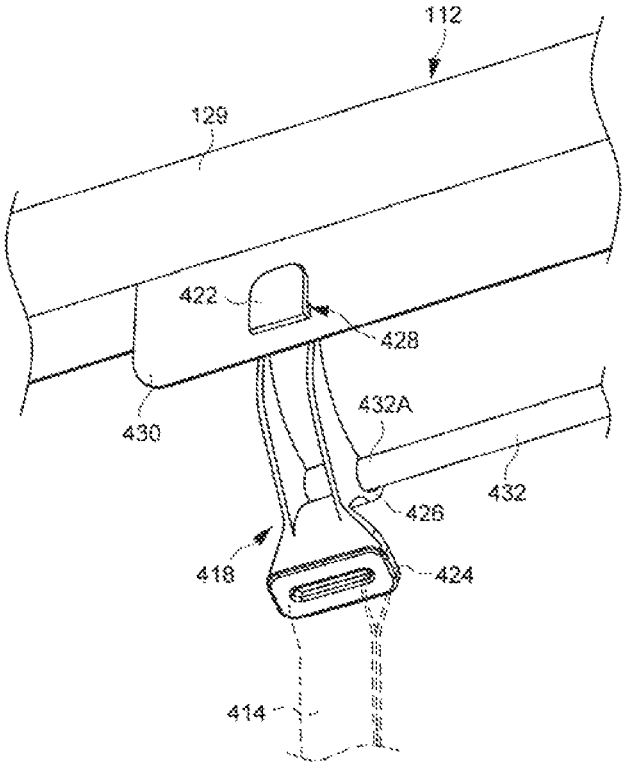
Figure 12:
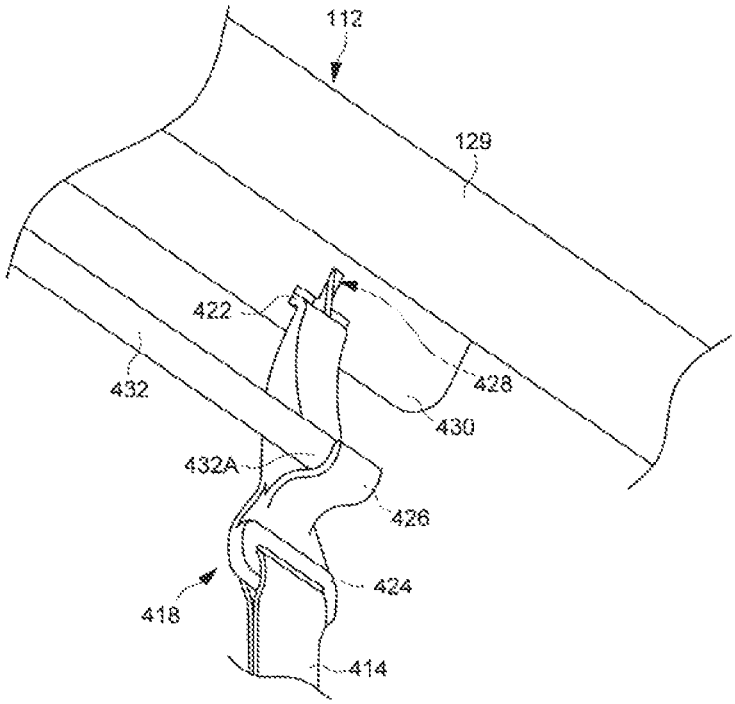

FIGS. 10-12 are schematic views illustrating another variant embodiment of a support frame 404 for the bassinet 202. The support frame 404 can include two frame segments 410, a linkage member 412, a plurality of straps 414 and 416, and a plurality of connectors 418 and 420. Each of the frame segments 410 can be formed as a tube having an elongated shape. The linkage member 412 can be a panel made of a webbing material that is attached to the two frame segments 410, thereby keeping the frame segments 410 linked with each other. The two frame segments 410 can be respectively suspended from the two upper side rail assemblies 112, each frame segment 410 being suspended by two straps 414 and 416. More specifically, the strap 414 can have two opposite end portions respectively connected with the frame segment 410 and one connector 418, and the strap 416 can have two opposite end portions respectively connected with the frame segment 410 and one connector 420.

The connector 418 can include a tongue 422, a loop 424 and a socket 426. In one embodiment, the connector 418, including the tongue 422, the loop 424 and the socket 426, may be formed in a single body by plastic molding. The tongue 422 can be arranged above the socket 426 and have a bent shape. The tongue 422 can engage through a slot 428 formed through a fixed wall 430 of the upper side rail assembly 112 so as to fasten the connector 418 to the upper side rail assembly 112. The fixed wall 430 can be exemplary formed as a downward extension of the rail segment 129 located near a middle of the upper side rail assembly 112. The loop 424 can be arranged below the socket 426, and the strap 414 can wrap through the loop 424 to attach the strap 414 with the connector 418.

The connector 420 can engage with one corner joint 116, and can include a loop through which the strap 416 can wrap to attach the strap 416 with the connector 420.

Once the support frame 404 is assembled with the playpen frame 102 in a suspended state substantially parallel to the upper side rail assemblies 112, the two frame segments 410 extend substantially parallel to a horizontal plane. The bassinet 202 then can be placed on the two frame segments 410. Moreover, two parallel bar segments 432 can be installed to support the utility accessory 206. Each bar segment 432 can be arranged so as to extend substantially parallel to and along one corresponding upper side rail assembly 112, a first end portion 432A of the bar segment 432 resting in contact with the socket 426, and a second end portion 432B of the bar segment 432 having an end connector 434 fastened to one corner joint 116. The utility accessory 206 (e.g., an organizer tray) then can be installed and supported on the two bar segments 432 side-by-side relative to the bassinet 202.

Figure 13:
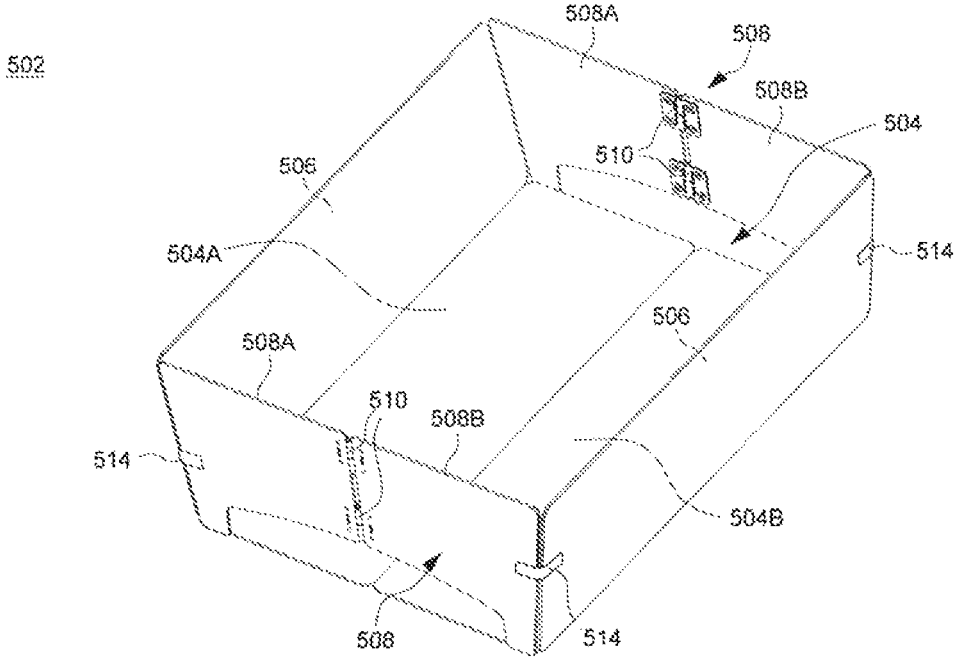
FIG. 13 is a schematic view illustrating the construction of a bassinet that may be used in combination with the playpen frame.

FIG. 13 is a schematic view illustrating the construction of a bassinet 502 that may be used in combination with the playpen frame 102 as described previously. The bassinet 502 can include a bottom board assembly 504 having a rectangular shape, two opposite first sidewalls 506 pivotally connected with the bottom board assembly 504, and two opposite second sidewalls 508 pivotally connected with the bottom board assembly 504. The bottom board assembly 504 can be formed by two panels 504A and 504B that are pivotally connected with each other along a central axis of the bottom board assembly 504. The two first sidewalls 506 can be respectively connected pivotally with two opposite first edges of the bottom board assembly 504, each first sidewall 506 being formed as an integral panel. The second sidewalls 508 can be respectively connected pivotally with two opposite second edges of the bottom board assembly 504. Each second sidewall 508 can be formed by two panels 508A and 508B that are pivotally connected with each other via one or more hinges 510 disposed at a central axis of the second sidewall 508. The bottom board assembly 504, and the first and second sidewalls 506 and 508 can be sewn into fabric cloths.

The first and second sidewalls 506 and 508 can be attached to one another via fastening straps 514 disposed adjacent to the four corners of the bassinet 502. The first and second sidewalls 506 and 508 can be thereby held in upright positions relative to the bottom board assembly 504 to surround the interior space of the bassinet 502.

Figure 14:
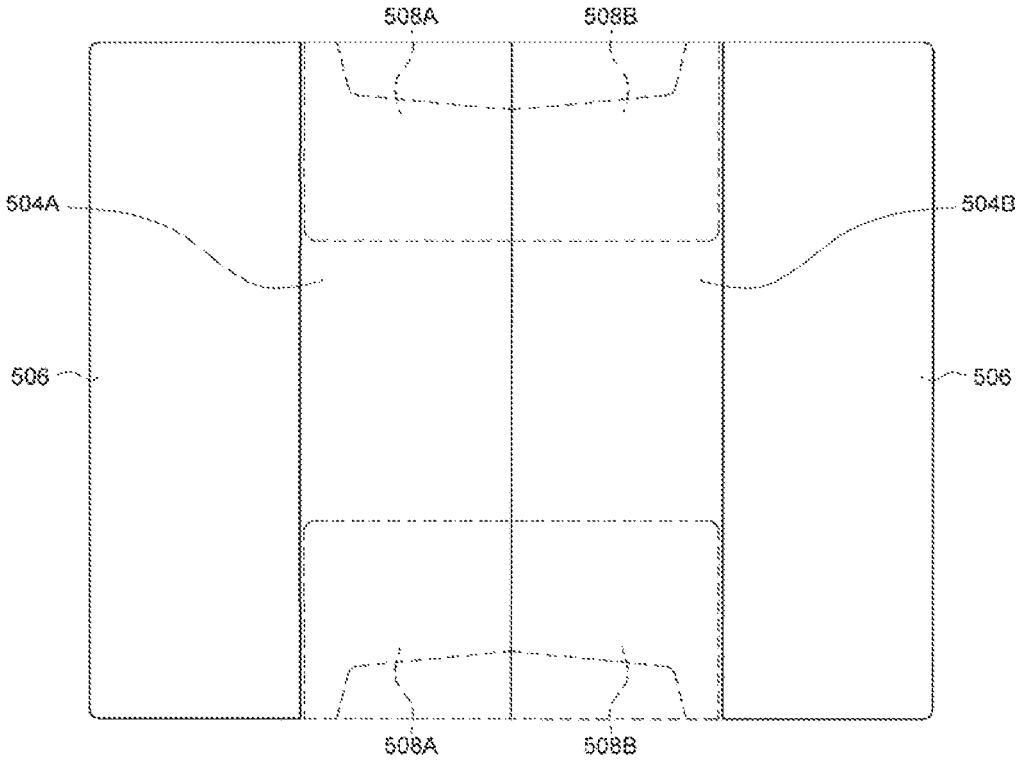
FIG. 14 is a schematic view illustrating the bassinet of FIG. 13 in a collapsed configuration forming a mattress.
Figure 15:
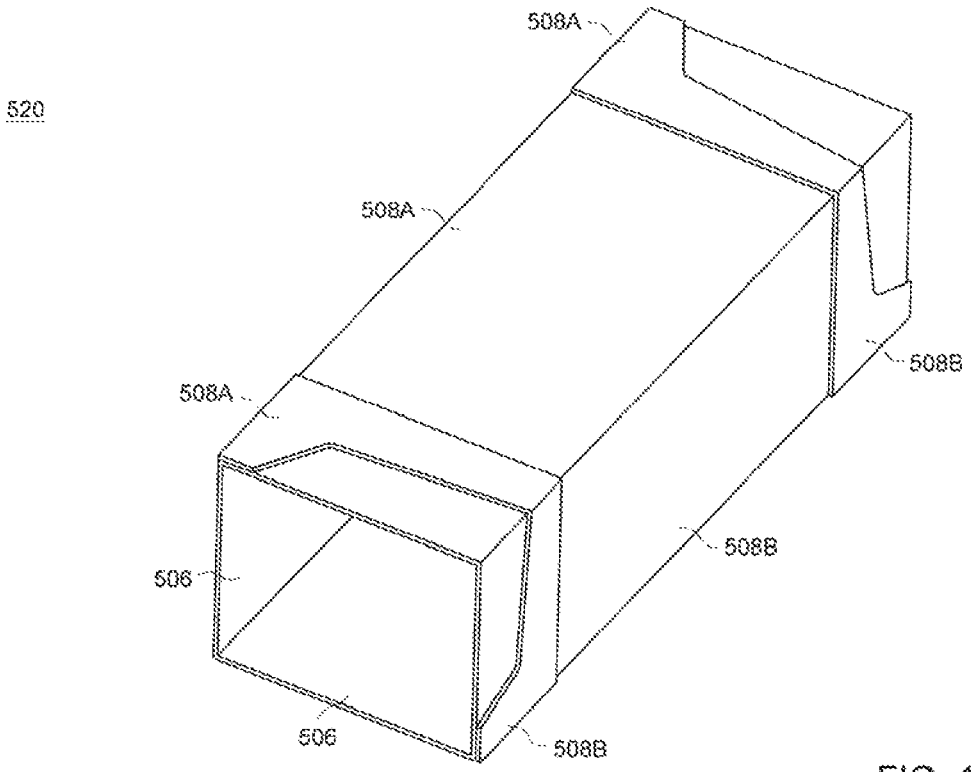
FIG. 15 is a schematic view illustrating the bassinet of FIG. 13 in a folded configuration forming an enclosure for receiving the playpen frame in a collapsed state.

The assembly of multiple panels as described previously can be variably configurable to form different structures, including a bassinet (as shown in FIG. 13), a mattress (as shown in FIG. 14), and a an enclosure (as shown in FIG. 15) adapted to receive a collapsed playpen frame.

FIG. 14 is a schematic view illustrating the bassinet 502 in a collapsed configuration. Once the fastening straps 514 are detached, the first sidewalls 506 can be laid horizontal substantially in the same plane as the bottom board assembly 504, and the second sidewalls 508 can be folded to a lower side of the bottom board assembly 504. This collapsed configuration can form a mattress that may be disposed at the bottom of the infant playpen 100.

FIG. 15 is a schematic view illustrating the bassinet 502 in a folded configuration. The first sidewalls 506 and the panels 504A and 504B of the bottom board assembly 504 can be folded so as to form a tube-like enclosure 520 having a rectangular section in which the two first sidewalls 506 can be adjacent to each other along one edge the enclosure 520. Moreover, the panels 508A and 508B of the second sidewalls 508 can be pivoted about the hinges 510 and folded onto an outer side of the enclosure 520. The playpen frame 102 once collapsed can be conveniently stored in the enclosure 520.

Figure 16:
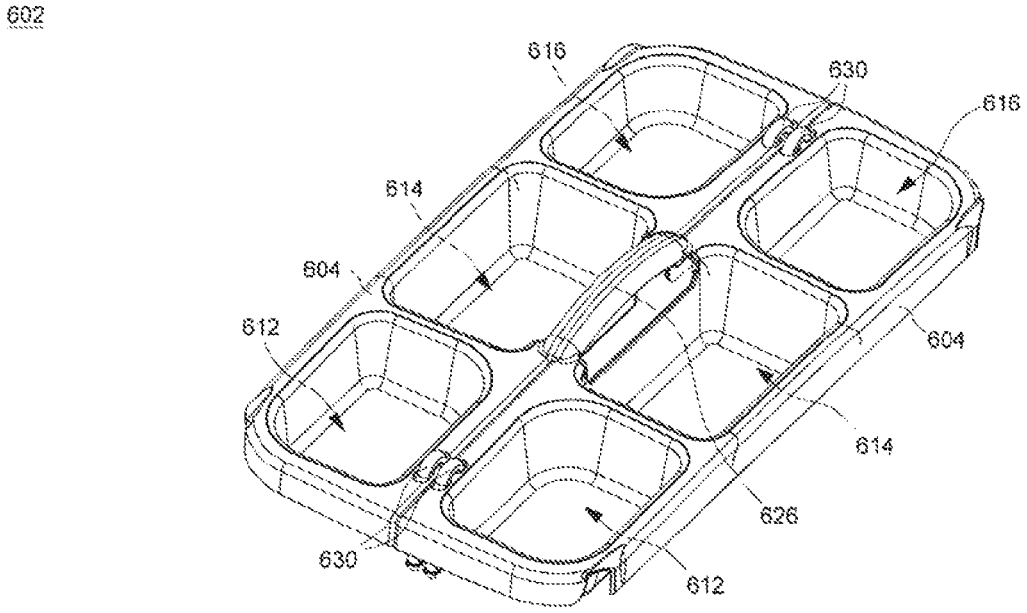
FIG. 16 is a schematic view illustrating the construction of an organizer tray that can be used in combination with the playpen frame.
Figure 17:
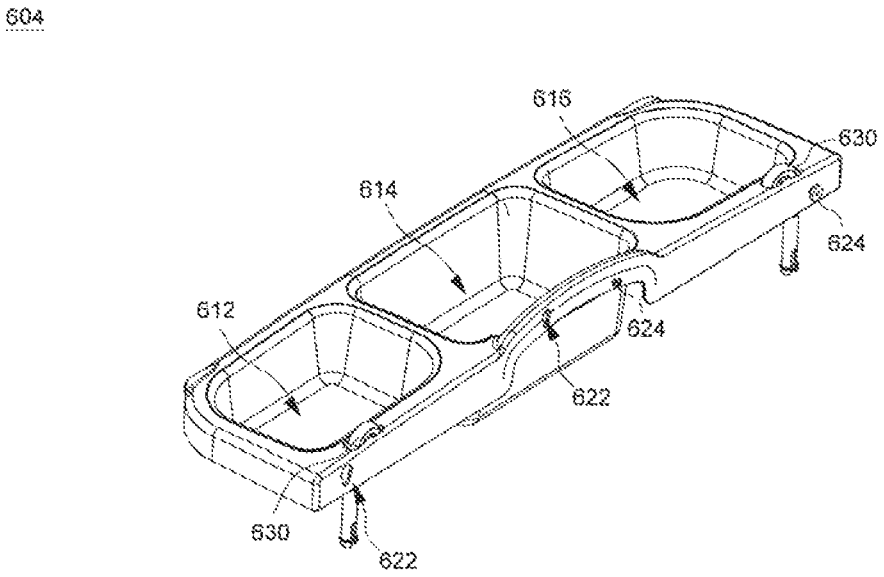
FIG. 17 is a schematic view illustrating one tray part used in the construction of the organizer tray shown in FIG. 16.

FIG. 16 is a schematic view illustrating the construction of an organizer tray 602 that can be used in combination with the playpen frame 102 as described previously. The organizer tray 602 can be formed by two tray parts 604 assembled with each other. FIG. 17 is a schematic view illustrating one tray part 604. Each of the two tray parts 604 can include a plurality of storage compartments 612, 614 and 616, which may be formed integrally with the tray part 604 by plastic molding. The two tray parts 604 and 606 can include holes 622 and flanges 624 that can engage with each other to assemble the organizer tray 602. The organizer tray 602 may be used independently, or in combination with the playpen frame 102 as described previously. The organizer tray 602 may further include a handle 626 for facilitating its portability.

Figure 18:
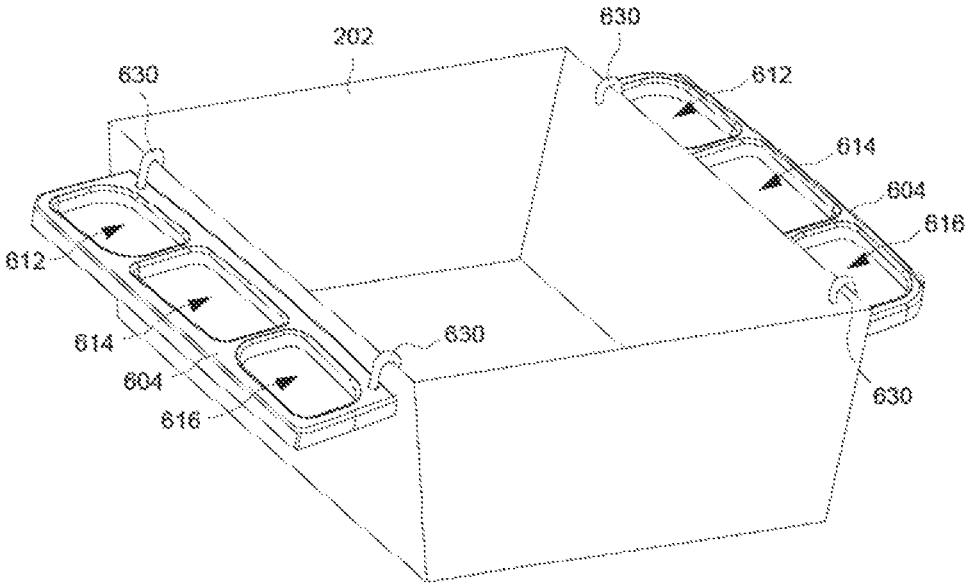
FIG. 18 is a schematic view illustrating the tray part of FIG. 17 independently installed on the bassinet.
Figure 19:
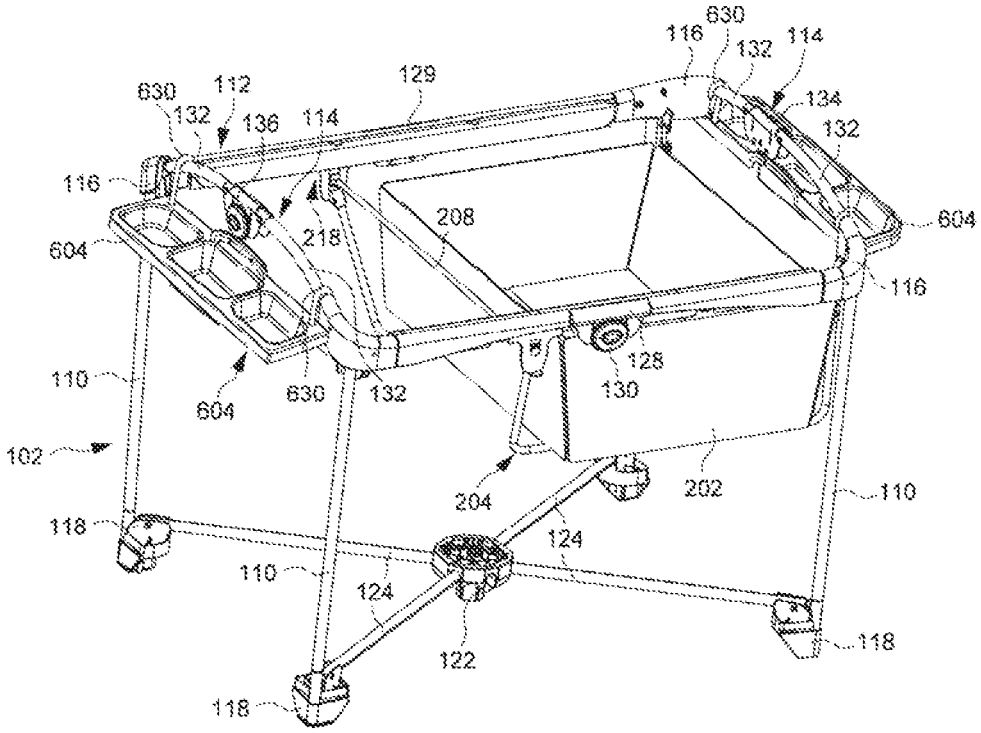
FIG. 19 is a schematic view illustrating the tray part of FIG. 17 installed on an upper side rail assembly of the playpen frame.

The two tray parts 604 can also be detached from each other and used separately. For example, each detached tray part 604 can fasten independently on the bassinet 202 as shown in FIG. 18, or on one upper side rail assembly 114 of the playpen frame 102 as shown in FIG. 19. In particular, the tray part 604 can include a plurality of hooks 630 that can engage with the upper side rail assembly 114 of the playpen frame 102 or a sidewall of the bassinet 202 to facilitate installation.

Figure 20:
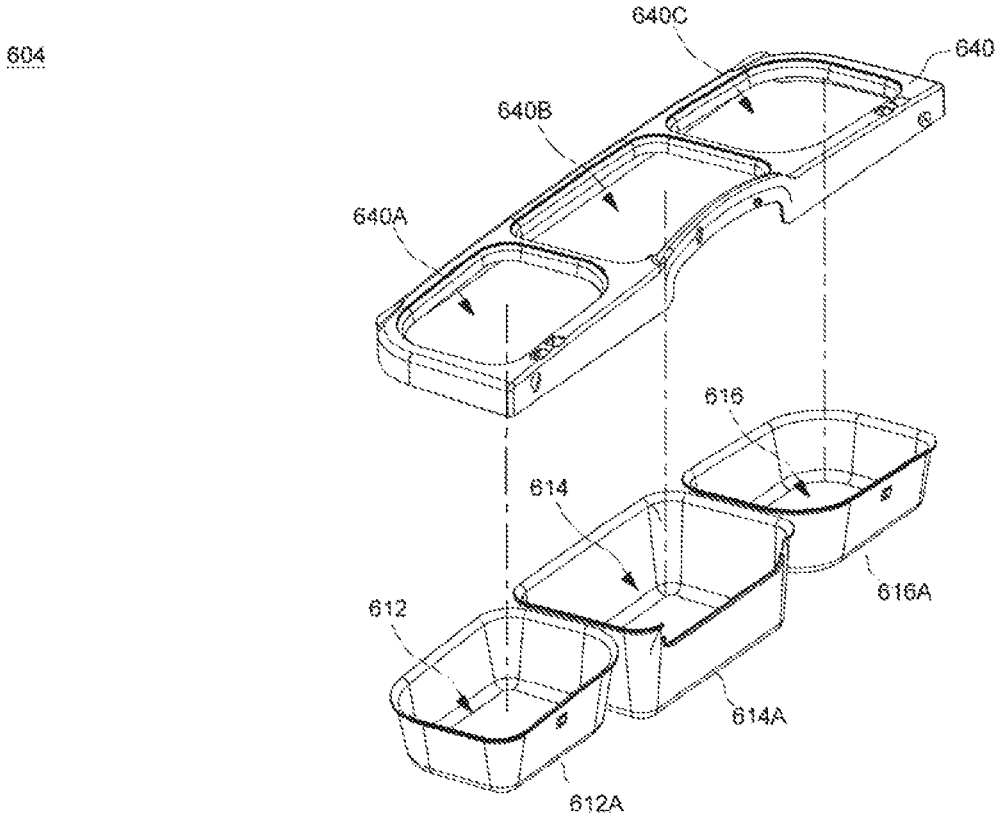
FIG. 20 is a schematic view illustrating a variant embodiment of the tray part shown in FIG. 17.

FIG. 20 is a schematic view illustrating a variant embodiment of the tray part 604. The tray part 604 can include a mount frame 640, and the compartments 612, 614 and 616 can be formed as containers 612A, 614A and 616A detachably assembled with the mount frame 420. For example, the mount frame 640 can have a plurality of openings 640A, 640B and 640C, and the containers 612A, 614A and 616A can have top rings that can snap with the mount frame 640 to respectively lie in alignment with the openings 640A, 640B and 640C. The detached containers 612A, 614A and 616A can be nested into each other separate from the mount frame 640, which can reduce the packaging volume. Moreover, the ability to detach one or more of the containers 612A, 614A and 616A from the mount frame 640 can allow a more flexible use of the organizer tray.

Advantages of the structures described herein include the ability to provide multiple accessories that can be used in combination with a playpen frame. The accessories can include a bassinet and a utility accessory, such as an organizer tray. The mount assembly used for installing the bassinet and the utility accessory with the playpen can include a support frame and a plurality of bar segments mountable to the playpen frame, the support frame being used to support the bassinet, and the bar segments being used to support the utility accessory. The support frame can include a plurality of connectors that can fasten to the playpen frame and also receive end portions of one or more bar segments. As a result, the number of connectors needed for installing the bar segments can be advantageously reduced, and the structure of the playpen frame can be simplified.

Realizations of the infant playpen and related accessories have been described in the context of particular embodiments. These embodiments are meant to be illustrative and not limiting. Many variations, modifications, additions, and improvements are possible. These and other variations, modifications, additions, and improvements may fall within the scope of the inventions as defined in the claims that follow.

What is claimed is:

1. A mount assembly for installing multiple accessories in an infant playpen, comprising: a playpen frame including two first upper side rail assemblies opposite to each other, and a second upper side rail assembly connected with the two first upper side rail assemblies, each of the two first upper side rail assemblies respectively having a fixed wall through which is formed a slot; a support frame configured to provide support for a bassinet in an interior of the playpen frame, the support frame including two connectors operable to respectively attach to and detach from the fixed walls, each of the two connectors being respectively formed to include a socket that is opened towards the two first upper side rail assemblies, and the two connectors being respectively engageable through the slots of the fixed walls respectively near a middle of the two first upper side rail assemblies, the bassinet being removably positionable on the support frame once the support frame is assembled with the playpen frame; and a plurality of bar segments mountable to the playpen frame to provide support for a utility accessory positioned side-by-side relative to the bassinet, one of the bar segments once mounted to the playpen frame having at least an end portion resting in contact with the socket of one of the two connectors.

2. The mount assembly according to claim 1, further including a strap having two end portions respectively coupled with the support frame and the playpen frame.

3. The mount assembly according to claim 2, wherein the second upper side rail assembly is respectively connected with the two first upper side rail assemblies at two corners of the playpen frame, the strap connecting to a middle region of the second side rail assembly between the two corners.

4. The mount assembly according to claim 2, wherein the second upper side rail assembly is respectively connected with the two first upper side rail assemblies via two corner joints, the strap connecting to a location of the playpen frame adjacent to one of the two corner joints.

5. The mount assembly according to claim 2, wherein the support frame includes an upright segment, and the strap is assembled with a loop provided at an end portion of the upright segment.

6. The mount assembly according to claim 1, wherein the bar segment resting in contact with the socket extends along the side of one of the two first upper side rail assemblies.

7. The mount assembly according to claim 6, wherein the bar segment resting in contact with the socket has an end portion that is operable to attach to the playpen frame adjacent to a corner joint thereof.

8. The mount assembly according to claim 1, wherein the bar segment resting in contact with the socket extends substantially perpendicular to the two first upper side rail assemblies.

9. The mount assembly according to claim 1, wherein the playpen frame includes two corner joints respectively connected with the two first upper side rail assemblies, and the bar segments include a first and a second bar segment, the first bar segment being positionable to rest in contact with the sockets of the two connectors, the second bar segment being positionable to rest in contact with the two corner joints.

10. The mount assembly according to claim 1, wherein each of the two connectors includes a clamping structure operable to engage with the fixed wall of one corresponding first upper side rail assembly.

11. The mount assembly according to claim 10, wherein each of the connectors, including the clamping structure and the socket thereof, is formed integrally in a single body.

12. The mount assembly according to claim 10, wherein each of the fixed walls further has a lower boundary edge, the clamping structure being operable to engage through the slot and press against the lower boundary edge.

13. The mount assembly according to claim 1, wherein the support frame includes a frame segment positionable to extend substantially parallel to a horizontal plane, the frame segment being suspended from one of the two connectors by at least one strap having two end portions respectively coupled with the frame segment and the connector.

14. The mount assembly according to claim 1, wherein the support frame includes an upright segment, and one of the connectors is affixed with an upper end of the upright segment.

15. The mount assembly according to claim 1, further including an organizer tray, the organizer tray being positionable on the bar segments once the bar segments are mounted to the playpen frame.

16. The mount assembly according to claim 15, wherein the organizer tray is formed by a first and a second tray part assembled with each other, the first and second tray part being operable to detach from each other and to fasten independently on the bassinet or any of the second upper side rail assemblies of the playpen frame.

17. A mount assembly for installing multiple accessories in an infant playpen, comprising: a playpen frame including two first upper side rail assemblies opposite to each other, and a second upper side rail assembly connected with the two first upper side rail assemblies, each of the two first upper side rail assemblies respectively includes two tubular segments pivotally connected with each other, and at least one rail segment assembled over at least one of the two tubular segments, each of the rail segments having a fixed wall formed as an extension projecting downward from the rail segment; a support frame configured to provide support for a bassinet in an interior of the playpen frame, the support frame including two connectors operable to respectively attach to and detach from the fixed walls, each of the two connectors being respectively formed to include a socket that is opened towards the two first upper side rail assemblies, and the two connectors being operable to attach to the fixed walls respectively near a middle of the two first upper side rail assemblies, the bassinet being removably positionable on the support frame once the support frame is assembled with the playpen frame; and a plurality of bar segments mountable to the playpen frame to provide support for a utility accessory positioned side-by-side relative to the bassinet, one of the bar segments once mounted to the playpen frame having at least an end portion resting in contact with the socket of one of the two connectors.

18. The mount assembly according to claim 17, further including a strap having two end portions respectively coupled with the support frame and the playpen frame.

19. The mount assembly according to claim 18, wherein the second upper side rail assembly is respectively connected with the two first upper side rail assemblies via two corner joints, the strap connecting to a location of the playpen frame adjacent to one of the two corner joints.

20. The mount assembly according to claim 18, wherein the support frame includes an upright segment, and the strap is assembled with a loop provided at an end portion of the upright segment.

21. The mount assembly according to claim 17, wherein the bar segment resting in contact with the socket extends substantially perpendicular to the two first upper side rail assemblies.

22. The mount assembly according to claim 17, wherein the playpen frame includes two corner joints respectively connected with the two first upper side rail assemblies, and the bar segments include a first and a second bar segment, the first bar segment being positionable to rest in contact with the sockets of the two connectors, the second bar segment being positionable to rest in contact with the two corner joints.

23. The mount assembly according to claim 17, wherein each of the two connectors includes a clamping structure operable to engage with the fixed wall of one corresponding first upper side rail assembly.

24. The mount assembly according to claim 23, wherein each of the fixed walls includes a slot and has a lower boundary edge, the clamping structure being operable to engage through the slot and press against the lower boundary edge.

25. The mount assembly according to claim 17, further including an organizer tray, the organizer tray being positionable on the bar segments once the bar segments are mounted to the playpen frame.

* * * * *